US005980368A

United States Patent [19]

Chang et al.

[11] Patent Number: 5,980,368

[45] Date of Patent: Nov. 9, 1999

[54] POLISHING TOOL HAVING A SEALED FLUID CHAMBER FOR SUPPORT OF POLISHING PAD

[75] Inventors: Shou-sung Chang, Sunnyvale; Shu-Hsin Kao, Redwood City; David E. Weldon, Santa Clara, all of Calif.

[73] Assignee: Aplex Group, Sunnyvale, Calif.

[21] Appl. No.: 08/964,774

[22] Filed: Nov. 5, 1997

[51] Int. Cl.[6] ..... B24B 21/00

[52] U.S. Cl. ..... 451/303; 451/173; 451/5

[58] Field of Search ..... 451/303, 5, 168, 451/173

[56] References Cited

U.S. PATENT DOCUMENTS

| | | | |
|---|---|---|---|
| 3,447,306 | 6/1969 | Jakimcius | 51/135 |
| 4,628,640 | 12/1986 | Johannsen | 51/141 |
| 5,081,795 | 1/1992 | Tanaka et al. | 51/131.1 |
| 5,297,361 | 3/1994 | Baldy et al. | 51/119 |
| 5,558,568 | 9/1996 | Talieh et al. . | |
| 5,593,344 | 1/1997 | Weldon et al. . | |
| 5,692,947 | 12/1997 | Talieh et al. | 451/41 |

*Primary Examiner*—Timothy V. Eley
*Assistant Examiner*—Dung Van Nguyen
*Attorney, Agent, or Firm*—Skjerven, Morrill, MacPherson Franklin & Friel LLP; David T. Millers

[57] ABSTRACT

A polishing tool uses a seal cavity containing a fluid that supports polishing pads against an object being polished. In one embodiment, the boundaries of the cavity include a support structure, a portion of a polishing material, and a seal between the support structure and the polishing material. The polishing material moves relative to the support structure and seal. A variety of seal configuration can maintain the fluid within the cavity. One seal includes an o-ring that the force of a spring, a magnet, or air pressure presses against the polishing material. A gas flow from outside the cavity or from an inlet inside the cavity can form a gas pocket in the cavity, adjacent the o-ring, to prevent leakage of the fluid past the o-ring. Another seal is formed by an aerostatic bearing. The fluid pressure in the cavity can be varied temporally to create vibrations in the polishing material to enhance polishing performance or can be varied spatially to change the pressure profile. One embodiment of the invention includes one or more fluid inlet/outlets to the cavity, one or more pressure regulators, and a controller that operates the pressure regulators to control the pressure in the cavity. In polishers with or without a sealed fluid cavity, the support structure can include actuators that control the orientation of the support structure relative to polishing material. Sensors and a feedback control system positions the support structure for polishing.

22 Claims, 4 Drawing Sheets

POLISHING TOOL HAVING A SEALED FLUID CHAMBER FOR SUPPORT OF POLISHING PAD

BACKGROUND

1. Field of the Invention

This invention relates to polishing systems and particularly to chemical mechanical polishing systems and methods using fluids to support a polishing pad.

2. Description of Related Art

Chemical mechanical polishing (CMP) in semiconductor processing removes the highest points from the surface of a wafer to polish the surface. CMP operations are performed on unprocessed and partially processed wafers. A typical unprocessed wafer is crystalline silicon or another semiconductor material that is formed into a nearly circular wafer. A typical processed or partially processed wafer when ready for polishing has a top layer of a dielectric material such as glass, silicon dioxide, or silicon nitride over one or more patterned layers that create local topological features on the order of about 1 $\mu$m in height on the wafer's surface. Polishing smoothes the local features so that ideally the surface of the wafer is flat or planarized over an area the size of a die formed on the wafer. Currently, polishing is sought that locally planarizes the wafer to a tolerance of about 0.3 $\mu$m over the area of a die about 10 mm by 10 mm in size.

A conventional belt polisher includes a belt carrying polishing pads, a wafer carrier head which holds a wafer, and a support assembly that supports the portion of the belt under the wafer. For CMP, the polishing pads are sprayed with a slurry, and pulleys drive the belt. The carrier head brings the wafer into contact with the polishing pads so that the polishing pads slide against the surface of the wafer. Chemical action of the slurry and the mechanical action of the polishing pads and particles in the slurry against the surface of the wafer remove material from the wafer's surface. U.S. Pat. Nos. 5,593,344 and 5,558,568 describe CMP systems using hydrostatic fluid bearings to support a belt. Such hydrostatic fluid bearings have fluid inlets and outlets for fluid flows forming films that support the belt and polishing pads.

To polish a surface to the tolerance required in semiconductor processing, CMP systems generally attempt to apply a polishing pad to a wafer with a pressure that is uniform across the wafer. A difficulty can arise with hydrostatic fluid bearings because the supporting pressure of the fluid in such bearings tends to be higher near the inlets and lower near the outlets. Accordingly, such fluid bearings often apply a non-uniform pressure when supporting a belt and polishing pads, and the non-uniform pressure may introduce uneven removal of material during polishing. Methods and structures that provide uniform polishing are sought.

SUMMARY

In accordance with the invention, a polishing tool uses a sealed fluid chamber with a regulated pressure to support a compliant polishing material. The fluid chamber can be static or nearly static and maintained at a constant pressure without fluid flow. Thus, higher and lower pressure areas around fluid inlets and outlets are avoided. However, the pressure field of the chamber can be varied temporally or spatially if desired. For temporal variation, a control circuit operates a pressure regulator to vary pressure in the cavity. Temporal variations in the pressure can introduce vibrations in the polishing material which improve polishing performance. For spatial variations, fluid inlets and outlets are distributed according to where higher or lower pressures are desired. Each fluid inlet/outlet can be connected to an independent pressure regulator and/or fluid supply so that the supporting fluid pressure in the immediate vicinity of the inlet/outlet depends on the pressure to the inlet/outlet. Baffles or barriers can be placed among the inlet/outlets to increase the differential pressures.

In one embodiment of the invention, fluid in the chamber is in direct contact with a moving belt that carries the polishing pads, and a seal between the fixed portion of the cavity and the belt prevents or reduces leakage from the cavity. One type of seal includes an o-ring that the force of a spring, a magnet, or air pressure presses against the belt. A gas flow from outside the cavity or from an inlet inside the cavity forms a gas pocket in the cavity, adjacent the o-ring, to prevent the fluid from reaching and leaking past the o-ring. Another seal is formed by an air or gas bearing. The fluid pressure in the cavity can be varied temporally to create vibrations in the polishing material and enhance polishing performance or can be varied spatially to change the pressure profile. One embodiment of the invention includes one or more fluid inlet/outlets to the cavity, one or more pressure regulators, and a controller that operates the pressure regulators to control the pressure in the cavity.

In accordance with another aspect of the invention, a support structure for a polishing material in a polisher is mounted on actuators that control the orientation of the support structure. During polishing, an object such as a wafer being polished can tilt which causes a similar tilt in the polishing material. To reduce unevenness of polishing, the support structure changes orientation to match the tilt in the polishing material. Sensors and a control system can monitor the orientation of the polishing material and direct the actuators to position the support structure accordingly. This aspect of the invention can be employed with a support using a sealed fluid pocket for support of the polishing material or using other devices such as a hydrostatic bearing to support the polishing material. In one particular embodiment, an aerostatic bearing seals a fluid pocket, and a control system operates actuators to orient the support structure so that the aerostatic bearing functions properly. In this embodiment, the sensors can include pressure sensors that sense a drop in local pressure in the sealed fluid pocket caused by leakage past the aerostatic bearing. Distance sensors measuring the distance between the support structure and the polishing material can also be used.

BRIEF DESCRIPTION OF THE DRAWINGS

Use of the same reference symbols in different figures indicates similar or identical items.

DETAILED DESCRIPTION OF THE PREFERRED EMBODIMENTS

Figure 1:
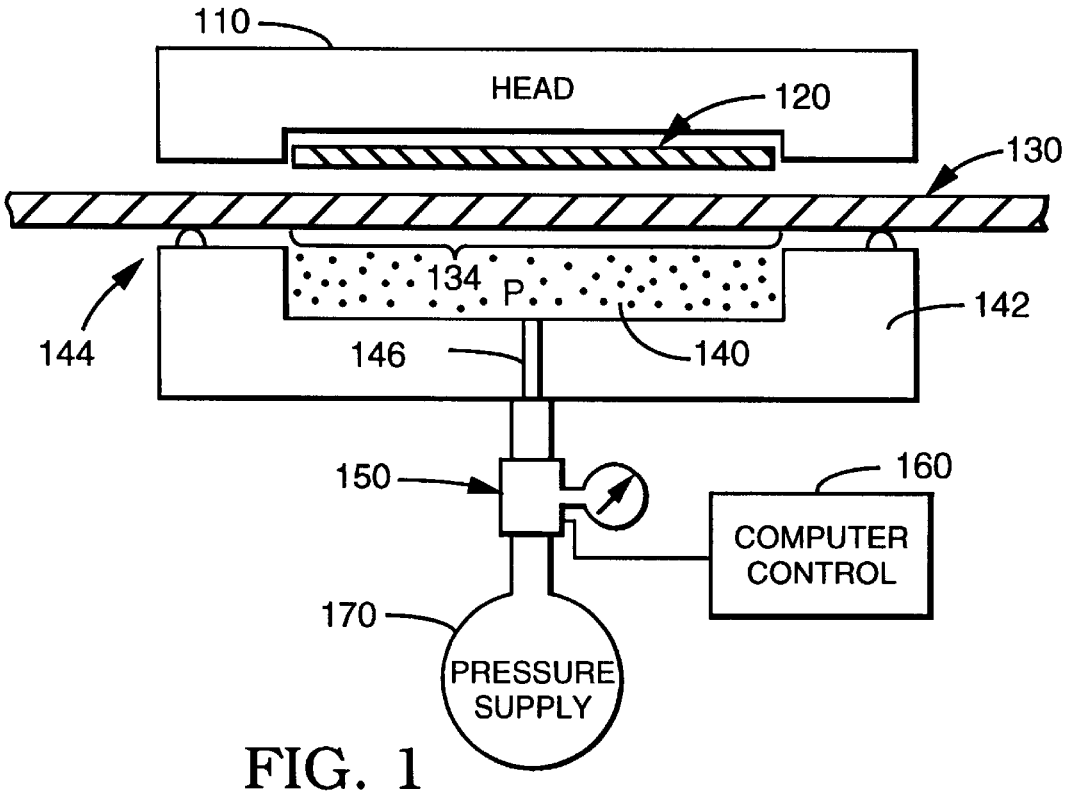
FIG. 1 shows a portion of a polishing tool that, in accordance with an embodiment of the invention, includes a sealed fluid chamber that supports a polishing pad.

In accordance with an embodiment of the invention, a fluid chamber with a regulated pressure supports a compliant polishing material in a polishing tool. The pressure field of the fluid chamber can be constant or varied temporally or spatially. FIG. 1 shows a polisher in accordance with the invention in which a carrier head 110 holds a wafer 120 in position against a compliant polishing material 130. Co-filed U.S. patent application Ser. No. 08/956,033 UNKNOWN, entitled "Wafer Carrier Head with Inflatable Bladder and Attack Angle Control for Polishing", describes suitable carrier heads and is hereby incorporated by reference herein in it entirety. Compliant polishing material 130 may include for example, an endless belt made of stainless steel of thickness 0.005" to 0.060" on which polishing pads made of IC1000, Suba IV, IC1400 or other comparable polishing materials are mounted. IC1000, Suba IV, and IC1400 are available from Rodel, Inc. The width of the belt depends on the size of wafer 120. A fluid that is substantially static is contained in a cavity 140 bounded by a fixed structure 142, a seal 144, and a portion 134 of compliant polishing material 130. The pressure of the fluid (typically in the range between 0 and 60 psi) supports a portion of compliant polishing material 130 that is directly under and in contact with wafer 120. Portion 134 is larger than the area directly under wafer 120. The fluid in cavity 140 is preferably a liquid such as water and is introduced to cavity 140 via an inlet/outlet 146. Inlet/outlet 146 is connected through a pressure regulator 150 to a pressure supply 170.

A controller 160 connected to regulator 150 selects a desired pressure for cavity 140. Pressure supply 170 selectably operates as either a fluid source or a fluid sink depending on whether the fluid pressure in cavity 140 is less or greater than the inlet/outlet pressure. In accordance with an aspect of the invention, computer controller 160 modulates a control signal to regulator 150 to temporally vary the pressure to inlet/outlet 146 and in chamber 140. Modulation of the pressure in cavity 140 can vibrate compliant polishing material 130. For example, modulating the pressure at a frequency between 1 kHz and 10 kHz induces vibrations of a similar frequency in the polishing material. Ultrasonic frequency vibrations could also be used. Such vibrations are believed to improve polishing performance, provided that natural or resonant frequencies of the system are avoided.

Figure 2:
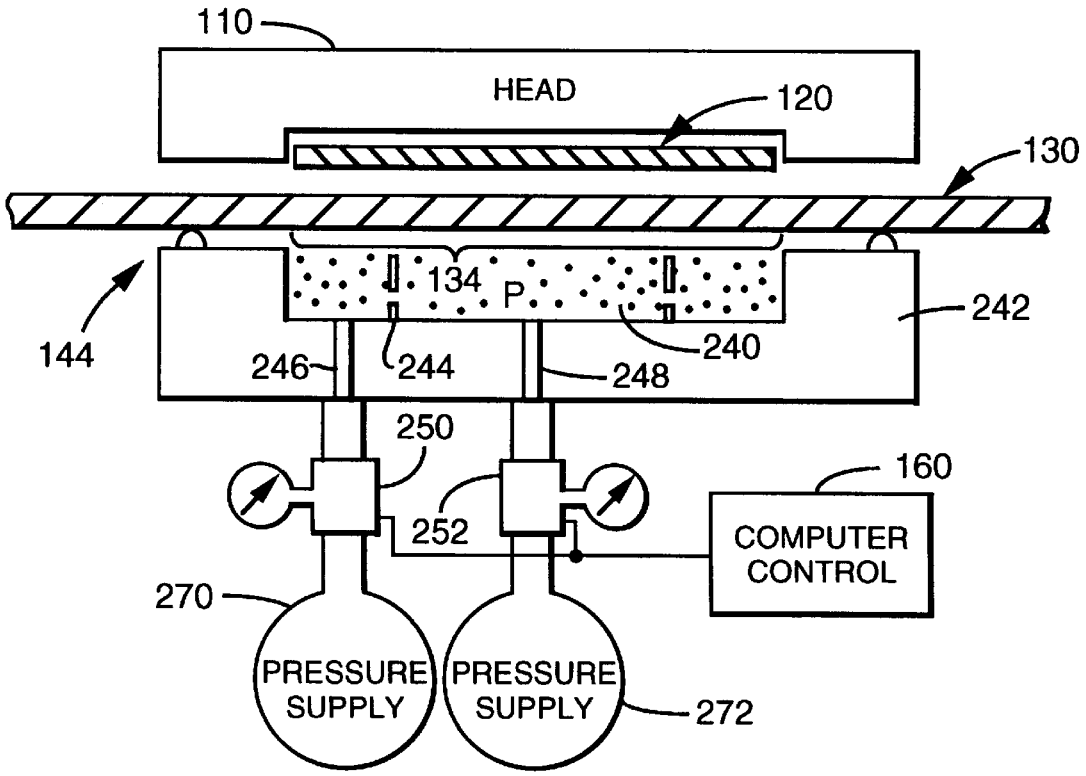
FIG. 2 shows a portion of a polishing tool that, in accordance with an embodiment of the invention, includes a sealed fluid chamber having a spatially modulated pressure.

FIG. 2 shows a portion of a polishing system using a cavity 240 containing a fluid with a spatially modulated pressure. Cavity 240 is in a structure 242 that includes multiple fluid inlets/outlets 246 and 248 which are connected to independent pressure supplies 270 and 272. Controller 160 uses separate pressure regulators 250 and 252 to control the pressures at inlet/outlets 246 and 248. With only two inlet/outlets as shown in FIG. 2, one of inlet/outlets 270 typically acts as a fluid inlet, and the other acts as a fluid outlet. In embodiments including more than two inlet/outlets, fluid flow among the inlet/outlets can be more varied, but the pressures near the inlets tend to be higher than the pressures near the outlets. Baffles 244 or barriers may be employed between inlet/outlet 246 and inlet/outlet 248 to restrict fluid flow and increase the pressure differential in the fluid. Controller 160 can maintain a constant pressure difference between inlet/outlets 244 and 248 or vary the pressure difference to create temporal pressure variations.

Spatial pressure variation in input pressure can address variations in the support pressure field of the sealed cavity. For example, if fluid leaks from cavity 240, pressure to inlets 246 and 248 can be adjusted to compensate for support pressure differences caused by the leakage. Additionally, spatial variation in fluid pressure can compensate for non-fluid support related effects. For instance, if a wafer rotates during polishing, the velocities of portions of the wafer relative to the pad change with radius. A fluid pocket with spatially varied pressure profile can compensate for the different removal rates caused by differences in wafer velocity relative to the belt. For example, the support pressure can provide a higher pressure under an area where relative velocity between the polishing material and the wafer is lower. The pressure profile can also be varied to compensate for unevenness in conditioning of the belt with slurry. Specifically, more pressure can be applied where polishing rates would otherwise be lower. Additionally, polishing action tends to wear the pad into the shape of a trough causing slower material removal from the portion of the wafer over central regions of the pad. The pad may further have a low spot at any position on the belt. Spatial and/or temporal variation in the pressure can be used to press harder on the belt at the low spots so that removal rates are more uniform and polishing performance is improved. Such pressure variations can be tied to a feedback loop including a sensor that measures the properties of the belt. Co-filed U.S. patent Application Ser. No. 08,946,772, entitled "In-Situ Monitoring of Polishing Pad Wear", describes polishers that include sensors for measuring polishing pads and control systems for changing the polisher's operating parameters (such as the pressure profile of a belt support) and is incorporated by reference herein in its entirety.

Figure 3:
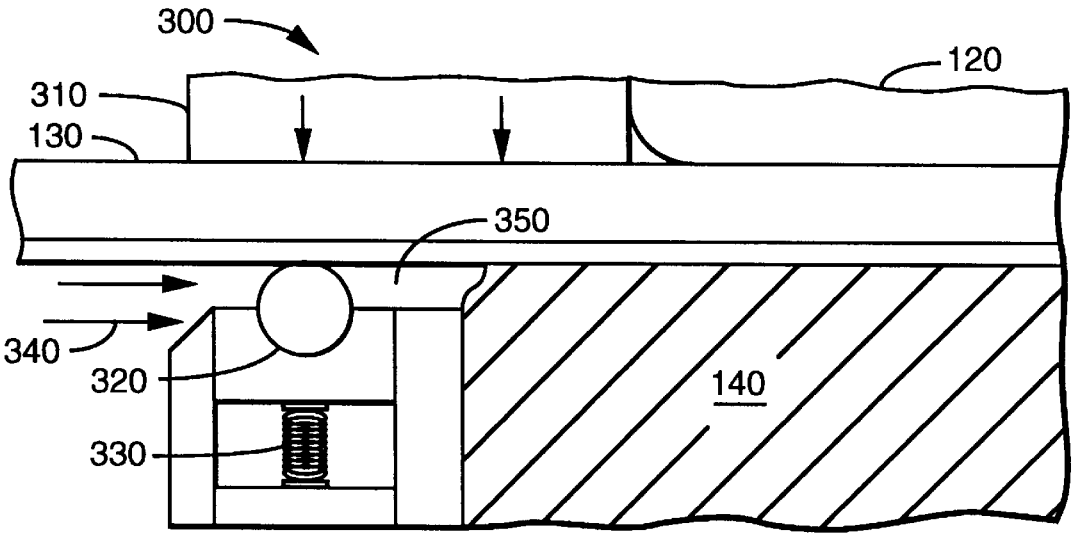
FIGS. 3, 4, and 5 show embodiments of seals suitable for the fluid chamber of FIGS. 1 and 2.

During polishing, polishing material 130 moves relative to fixed structure 142 and seal 144. Seal 144 is at the interface between fixed structure 142 and compliant polishing material 130 and prevents or reduces fluid leakage from chamber 140. FIG. 3 shows an embodiment of a seal 300 that is suitable for sealing cavity 140. Seal 300 includes an o-ring 320 that a mechanism including a spring 330 presses against the underside of polishing material 130. A variety of alternative structures can be used in place of o-ring 320. For example, a face sealing lip could be applied to the polishing material 130. To reduce friction and wear, o-ring 320 can be replace by a magnetic fluid magnetically confined to the gap between polishing material 130 and fixed structure 142.

Alternative mechanisms for applying o-ring 320 to polishing material 130 include a pressurized or hydraulic cylinder or a magnet. A magnet in a structure 310 on an opposite side of belt 130 from o-ring 320 can attract iron or a magnetic material under o-ring 320 to press o-ring 320 against polishing material 130. Alternatively, a magnet under o-ring 320 can either be attracted to iron or any magnetic material in structure 310 or in the polishing material 130. For example, a belt in a belt polisher can include iron (e.g., a stainless steel belt) or any magnetic material so that mutual attraction between the magnet under o-ring 320 and the belt presses o-ring 320 into polishing material 130. When magnetic attraction to the belt is used, structure 310 on the side of polishing material 130 opposite o-ring 320 is not required. Otherwise, structure 310 applies an opposing force to keep polishing material 130 from moving away from o-ring 320. Structure 310 may be, for example, a portion of carrier head 110 or an independent structure having a fixed location relative to cavity 140.

Figure 4:
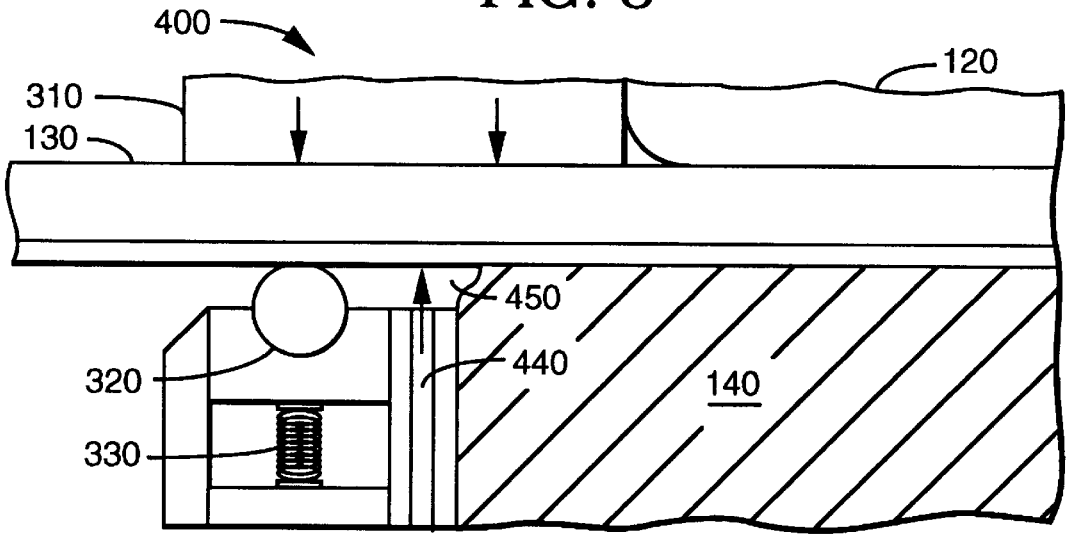

To improve the seal provided by o-ring 320, an air (or other gas) flow 340 is directed at o-ring 320 from outside cavity 140. The air flow is at a pressure greater than the pressure of fluid 140 so that any leakage past o-ring 320 into cavity 140 and forms a gas pocket 350 adjacent o-ring 320. Gas pocket 350 prevents fluid from leaking out of cavity 140. FIG. 4 shows a seal 400 that contains many of the same elements as seal 300 of FIG. 3. Seal 400 differs from seal 300 by including a gas inlet 440 inside cavity 140 and adjacent o-ring 320. An inflow through inlet 440 forms a gas pocket 450 which keeps fluid in cavity 140 and away from seal 320. Accordingly, any leakage past o-ring 320 is predominately gas from pocket 450, and the fluid that supports polishing material 130 under wafer 120 is kept in cavity 140. If desired, a gas outlet from gas pocket 350 or 450 can be provided in cavity 140 to improve regulation of the pressure in the gas pocket.

Figure 5:
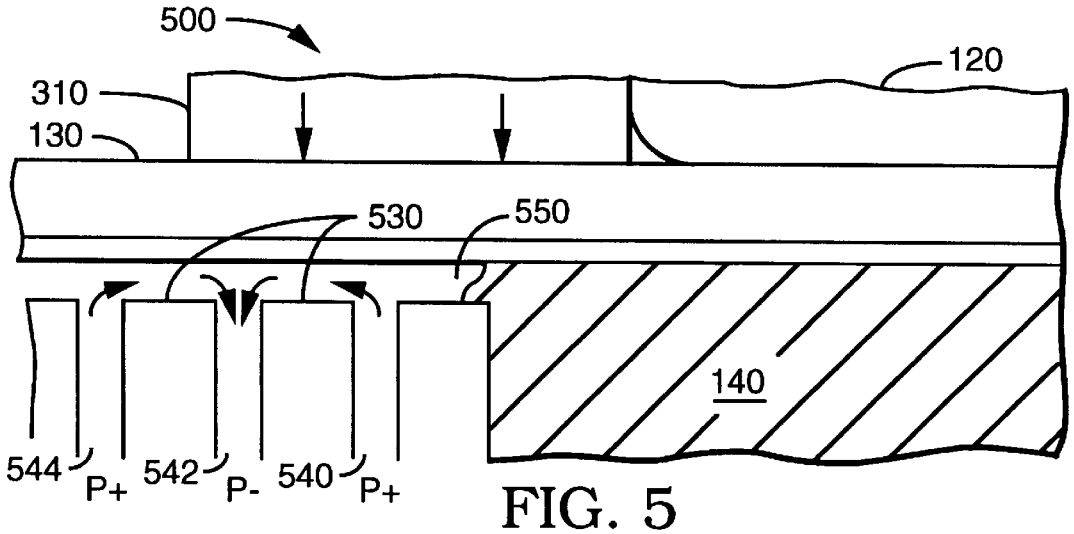

FIG. 5 shows a seal 500 which uses an aerostatic bearing to prevent leakage from cavity 140. The aerostatic bearing has the advantage of providing a nearly frictionless contact that will not generate particles that can interfere with polishing. The aerostatic bearing includes gas inlets 540 and 544 and a gas outlet 542 that are arranged around the perimeter of cavity with inlet 540 being closest to the fluid that supports the polishing material beneath wafer 120. Gas from inlets 540 and 544 flow out through outlet 542 forming a cushion between fixed surfaces 530 and polishing material 130. The gas pressure to fluid inlets 540 is higher than the fluid pressure in cavity 140 so that a gas pocket 550 forms and stops or reduces fluid leakage from cavity 140. In an exemplary embodiment, the pressure at inlets 540 and 544 is about 5 to 100 psi, the pressure at outlet 542 is about 0 to −10 psi, and the gap between surfaces 530 and polishing material 130 is between about 5 and 20 $\mu$m.

Figure 6:
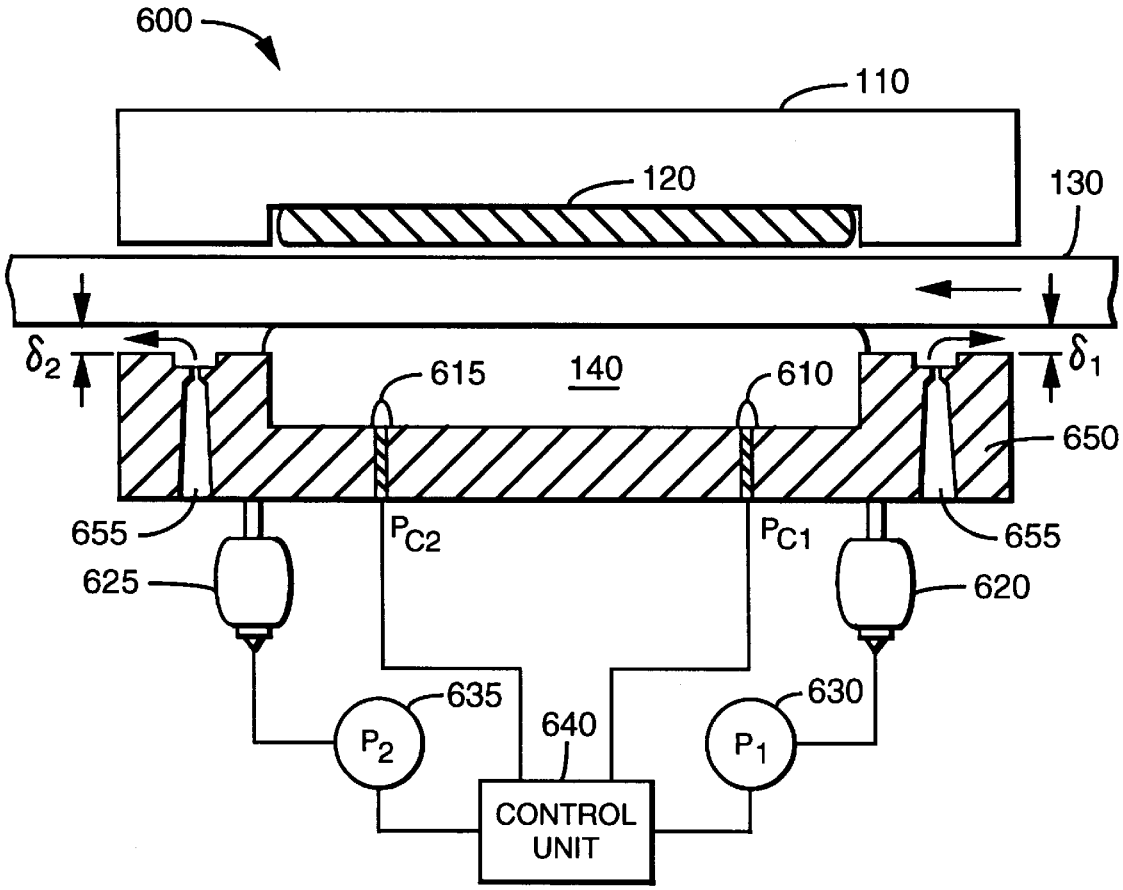
FIGS. 6 and 7 show embodiments of support structures which adjust orientation to accommodate the orientation of a polishing material.

FIG. 6 shows a polisher 600 having a support structure 650 that includes an aerostatic 655 bearing to seal a fluid pocket 140. The aerostatic bearing 655 has several parameters such as orifice size, gas flow rate, gas pad size, and landing size that are selected according to the requirements of polisher 600. In particular, the size of wafer 120 to be polished determines the required diameter of fluid pocket 140 and the diameter of the aerostatic bearing that surrounds fluid pocket 140. The aerostatic bearing 655 should approximately match the diameter of carrier head 110 which holds wafer 120. The aerostatic bearing 655 also requires a stiffness and load capacity selected according to pressures applied during polishing.

The thickness of the gas film flowing between structure 650 and belt 130 is critical to operation of an aerostatic bearing/seal. Film thicknesses 61 and 82 are for gaps on opposite sides of the aerostatic bearing 655 and ideally should be equal. During polishing, motion of belt 130 causes friction and a shear force on wafer 120 that may cause wafer 120 to tilt. This can cause belt 130 to tilt and change film thicknesses $\delta 1$ and $\delta 2$. In a worst case, the aerostatic bearing 655 fails and allows the moving belt 130 to contact support structure 650. In accordance with an aspect of the invention, support structure 650 has a mounting that permits tilting of structure 650 to match the angle of belt 130 and a control system that monitors the relative orientation of support structure 650 and belt 130 and adjusts the orientation of support structure 650 as required to maintain a uniform gap for the aerostatic bearing 655. Such control systems can be implemented using special purpose hardware and/or a general purpose computer system executing appropriate software.

In FIG. 6, support structure 650 is mounted on air springs 620 and 625 that are respectively connected to independent pressure sources 630 and 635. Pressure sensors 610 and 615, which measure local pressure in fluid pocket 140, are the same distance from the aerostatic bearing 655 and near associated air springs 620 and 625 respectively. If during polishing belt 130 tilts and changes gaps $\delta 1$ and $\delta 2$, fluid leakage from pocket 140 increases at the wider gap $\delta 1$ or $\delta 2$, causing fluid pressure to drop near the wider gap. A control unit 640, which is connected to pressure sensors 610 and 615 and to the pressure sources 630 and 635 for air springs 620 and 625, detects difference between pressures measured by sensors 620 and 615 and responds by increasing the pressure to the air spring 625 or 620 near the wider gap and/or decreasing the pressure to the air spring 620 or 625 near the narrower gap. The change in pressure to the air springs 620 and 625 causes support structure 650 to tilt until sensors 610 and 615 measure the same pressure, indicating gaps $\delta 1$ or $\delta 2$ are the same.

Figure 7:
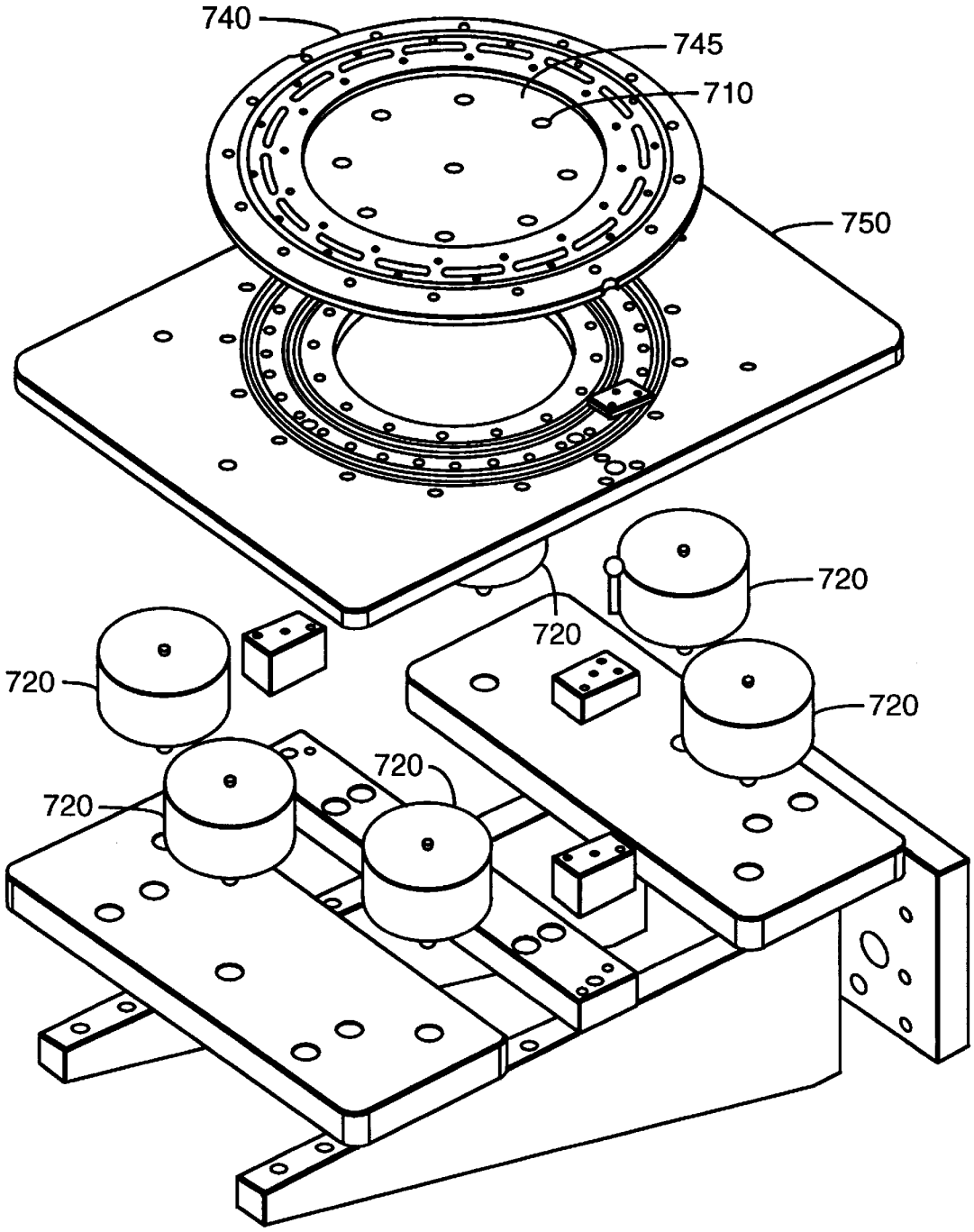

More generally to control the air gap and orientation for an aerostatic bearing requires three or more actuators. FIG. 7 shows an expanded perspective view of a support using six air bearings 720. Mounted on air springs 720 are plates 740 and 750 which include a cavity 745 for a fluid pocket. In cavity 745 are eight pressure sensors 710. A control circuit uses measurements from pressure sensors 710 to determine the pressure distribution in the cavity and from the determined pressure distribution pressurizes air springs 720 as required for proper operation of an aerostatic bearing formed between plate 740 and a polishing material being supported.

The embodiments of FIGS. 6 and 7 can be altered in a variety of ways in keeping with the invention. For example, any actuators, such as piezoelectric transducers, hydraulic cylinders, or solenoids can be employed instead of the air springs to control the orientation of the support structure. Additionally, distance sensors, which directly measure the gaps between the support structure and the overlying belt can be used instead of or in combination with pressure sensors in a cavity. A control system uses multiple distance measurements to position the support structure. Further, although the adjustable mounting and feedback control systems have been described for use with supports including sealed fluid pockets having surrounding aerostatic bearings, other embodiments of the invention can include a support with an adjustable orientation and a control system to match the orientation of a polishing material but without a sealed fluid pocket or aerostatic bearing. For example, such embodiments can employ a hydrostatic bearing to support a polishing material with or without a surrounding aerostatic seal. U.S. patent Application. Ser. No. 08/964,773, entitled "Polishing System Including a Hydrostatic Fluid Bearing Support", which is hereby incorporated by reference herein in its entirety, describes hydrostatic bearings suitable for use with in a support having an adjustable orientation. A solid support bearing could also be employed. In such embodiments, the support adjusts its orientation to accommodate tilt of an object being polished. Accordingly, the support provides a more even polishing pressure.

Although the invention has been described with reference to particular embodiments, the description is only an example of the invention's application and should not be taken as a limitation. Various adaptations and combinations of features of the embodiments disclosed are within the scope of the invention as defined by the following claims.

We claim:

1. A support for a polishing tool, comprising:

a compliant polishing material;

a support structure that includes a depression disposed adjacent the compliant polishing material;

a seal that surrounds the depression, the seal extending from the support structure to the compliant polishing material; and fluid enclosed in a cavity bounded by the depression, the seal, and a portion of the compliant polishing material, wherein a pressure of the fluid supports the polishing material.

2. The support of claim 1, wherein the fluid is substantially static.

3. The support of claim 1, wherein the seal comprises an o-ring that surrounds the cavity.

4. The support of claim 3, wherein the seal further comprises a gas pocket adjacent the o-ring, wherein the gas pocket prevents the fluid from leaking past the o-ring.

5. The support of claim 4, further comprising a gas inlet adjacent the o-ring, wherein gas in the gas pocket is introduced via the gas inlet.

6. The support of claim 4, further comprising a source of a gas flow from outside the cavity toward the o-ring, wherein gas in the gas pocket is introduced from the gas flow via leakage past the o-ring.

7. The support of claim 3, further comprising a spring mechanism that presses the o-ring against the compliant polishing material.

8. The support of claim 3, further comprising a magnet that presses the o-ring against the compliant polishing material by magnetic force.

9. The support of claim 8, wherein the compliant polishing material contains iron and the magnet that presses the o-ring against the compliant polishing material by the magnetic force cause by attraction between the magnet and the compliant polishing material.

10. The support of claim 1, further comprising:

a fluid supply;

a fluid inlet/outlet to the cavity;

a pressure regulator coupled to the fluid supply and the inlet/outlet; and a controller coupled to the pressure regulator, wherein the controller operates the pressure regulator to vary fluid pressure in the cavity.

11. The support of claim 10, further comprising:

a plurality of fluid inlet/outlets to the cavity; and a plurality of pressure regulators, each pressure regulator being coupled to an associated inlet/outlet.

12. The support of claim 1, wherein the seal comprises an aerostatic bearing.

13. The support of claim 12, further comprising an adjustable mounting that allows tilting of the support structure to match orientation with the polishing material.

14. The support of claim 13, further comprising: sensors that measure the relative orientation of the polishing material and the support structure;

actuators capable of adjusting the orientation of the support structure; and a control system coupled to the sensors and the actuators.

15. A support for a polishing material in a polisher, comprising:

a support structure;

sensors that measure the relative orientation of the polishing material and the support structure;

actuators capable of adjusting the orientation of the support structure; and a control system coupled to the sensors and the actuators, wherein the control system operates the actuators to keep the support structure oriented for polishing.

16. The support structure of claim 15, wherein the support structure comprises:

a cavity for containing a sealed fluid pocket that supports the polishing material; and an aerostatic bearing that surrounds the cavity and is disposed adjacent the polishing material.

17. The support structure of claim 16, wherein the sensors comprise pressure sensors disposed in the cavity for measuring local pressure in the fluid pocket.

18. A method for polishing an object, comprising:

placing the object in contact with a polishing material;

supporting the polishing material using a sealed fluid pocket having a plurality of inlet/outlets;

applying fluid at a first pressure to a first of the inlet/outlets and a second pressure to a second of the inlet/outlets, wherein pressures to the inlet/outlets control a support pressure profile of the fluid pocket; and moving the polishing material relative to the object while the fluid pocket supports the polishing material.

19. The method of claim 18, wherein the pressure profile provides a higher pressure where material removal rate from the object would otherwise be lower during polishing.

20. The method of claim 19, wherein the support pressure profile provides a higher pressure under a low spot in the polishing material.

21. The method of claim 19, wherein the support pressure profile provides a higher pressure under an area where relative velocity between the polishing material and the object is lower.

22. The method of claim 19, wherein the object is a wafer.

* * * * *